US007404265B2

(12) United States Patent
Wendelken et al.

(10) Patent No.: US 7,404,265 B2
(45) Date of Patent: Jul. 29, 2008

(54) IRONING BOARD

(75) Inventors: Hans-Juergen Wendelken, Sinsheim (DE); Joachim Wolf, Weinheim (DE); Johannes Flath, Heidelberg (DE); Barbara Helmerking, Weinheim (DE); Carl-Uwe Tintelnot, Weinheim (DE)

(73) Assignee: Carl Freudenberg KG, Weinheim (DE)

( * ) Notice: Subject to any disclaimer, the term of this patent is extended or adjusted under 35 U.S.C. 154(b) by 425 days.

(21) Appl. No.: 10/523,559

(22) PCT Filed: Jul. 19, 2003

(86) PCT No.: PCT/EP03/07903

§ 371 (c)(1),
(2), (4) Date: Sep. 6, 2005

(87) PCT Pub. No.: WO2004/015191

PCT Pub. Date: Feb. 19, 2004

(65) Prior Publication Data

US 2006/0117615 A1 Jun. 8, 2006

(30) Foreign Application Priority Data

Aug. 2, 2002 (DE) ..... 102 35 655

(51) Int. Cl.
*D06F 81/14* (2006.01)
*D06F 81/00* (2006.01)

(52) U.S. Cl. ..... 38/140

(58) Field of Classification Search ..... 38/135–140, 38/66; 150/154, 158, 165
See application file for complete search history.

(56) References Cited

U.S. PATENT DOCUMENTS

| | | | | | |
|---|---|---|---|---|---|
| 1,157,586 | A | * | 10/1915 | Rosenbloom | 38/137 |
| 1,664,916 | A | * | 4/1928 | Colclough | 38/140 |
| 1,861,493 | A | | 6/1932 | Davis | |
| 2,325,493 | A | * | 7/1943 | Fay | 38/137 |
| 2,459,213 | A | * | 1/1949 | Bellamy | 38/66 |
| 2,504,560 | A | | 4/1950 | McCory | 38/140 |
| 2,687,587 | A | * | 8/1954 | Strom et al. | 38/137 |
| 2,866,284 | A | * | 12/1958 | McCrory | 38/140 |
| 4,769,894 | A | * | 9/1988 | Simpson | 29/437 |
| 6,327,800 | B1 | * | 12/2001 | Daams | 38/137 |

FOREIGN PATENT DOCUMENTS

| | | |
|---|---|---|
| DE | 481318 | 8/1929 |
| DE | 7013303 | 8/1970 |
| EP | 0 043 700 | 1/1982 |
| GB | 2 116 216 | 9/1983 |
| JP | 04354999 | 12/1992 |

* cited by examiner

*Primary Examiner*—Ismael Izaguirre
(74) *Attorney, Agent, or Firm*—Davidson, Davidson & Kappel, LLC

(57) ABSTRACT

An ironing board includes a heat-resistant ironing board cover which can be placed thereon and includes elastic padding. The inventive ironing board includes a peripheral edge which projects past the surface of the ironing board and holds the padding in place.

10 Claims, 4 Drawing Sheets

IRONING BOARD

BACKGROUND

The present invention relates to an ironing board.

Ironing boards are generally constructed from a metal grid on which a heat-resistant ironing board cover having an elastic padding is placed. The ironing board cover and padding are often separate parts. The padding is loosely placed on the ironing board, and the heat-resistant cover is attached to the ironing board using a peripheral cord or via rubber bands. Both the cover and the elastic padding may be displaced with respect to one another during ironing and then form folds which are transferred to the object to be ironed during the ironing process.

To remedy this situation, ironing board covers have become known in which the elastic padding is directly bonded to the cover by gluing or other methods. European Patent Application EP 0 043 700 A1 describes such an option. To prevent the cover provided with the padding from shifting on the ironing board, a glue is applied to the padding, resulting in the padding being glued to the ironing board when the cover is subjected to heat and pressure, for example, by the iron.

It has been found, however, that such a procedure is not very advantageous, because the padding is bonded to the ironing board too strongly, making the replacement of the ironing board cover particularly difficult. Therefore, materials have been developed for the padding which provide bonding to the ironing board, but do not adhere in such a way that the padding cannot be removed from the ironing board. Such an option is described in GB 2 116 216 A.

SUMMARY OF THE INVENTION

A object of the present invention is to provide an ironing board having a heat-resistant ironing board cover and elastic padding in such a way that said the parts remain in a predefined position with respect to one another so that undesirable folds are not formed and the replacement of the individual parts is possible.

The present invention provides an ironing board having a heat-resistant ironing board cover placeable thereon including an elastic padding in that the ironing board has an edge standing out over its surface and holding the padding in an unshiftable manner. The padding is held in an unshiftable manner by the edge. The ironing board cover may be placed on the padding and attached to the ironing board using fastening elements known per se. However, the padding is preferably directly bonded to the ironing board cover by a lamination process, either by gluing or via other options.

The padding may be designed such that it is enclosed by the edge of the ironing board. In this way it rests in an unshiftable manner on the ironing board. However, the bottom of the padding is preferably provided with a peripheral groove which encloses the edge of the ironing board. It is pulled over the edge of the ironing board using this groove. This provides very accurate attachment of the padding to the ironing board.

In a further embodiment of the present invention, the padding may be provided with a bulge which engages with the ironing board edge from behind. This further reinforces the attachment of the padding to the ironing board.

To allow existing ironing boards to be equipped with the novel ironing board cover and padding, the edge may also be designed as a separate element attachable to the ironing board. The edge is then provided with a peripheral section corresponding to the contour of the ironing board and enclosing the edge of the ironing board, so that it may be placed on the ironing board in a fixed manner. In general, it is advantageous if the edge stands out over the ironing board surface 0.2 to 5 cm, preferably 0.5 to 2 cm. The edge may have a tapered design to facilitate installation of the padding on the edge. The base of the tapered edge may have a width of 0.1 to 1.5 cm depending on the size of the ironing board.

To achieve good ironing results, the padding is preferably manufactured from an intrinsically rigid hard foam. This is particularly advantageous if the padding has a greater than normal thickness.

BRIEF DESCRIPTION OF THE DRAWING

The appended drawings describe the present invention in more detail on the basis of two exemplary embodiments.

DETAILED DESCRIPTION

Figure 1:
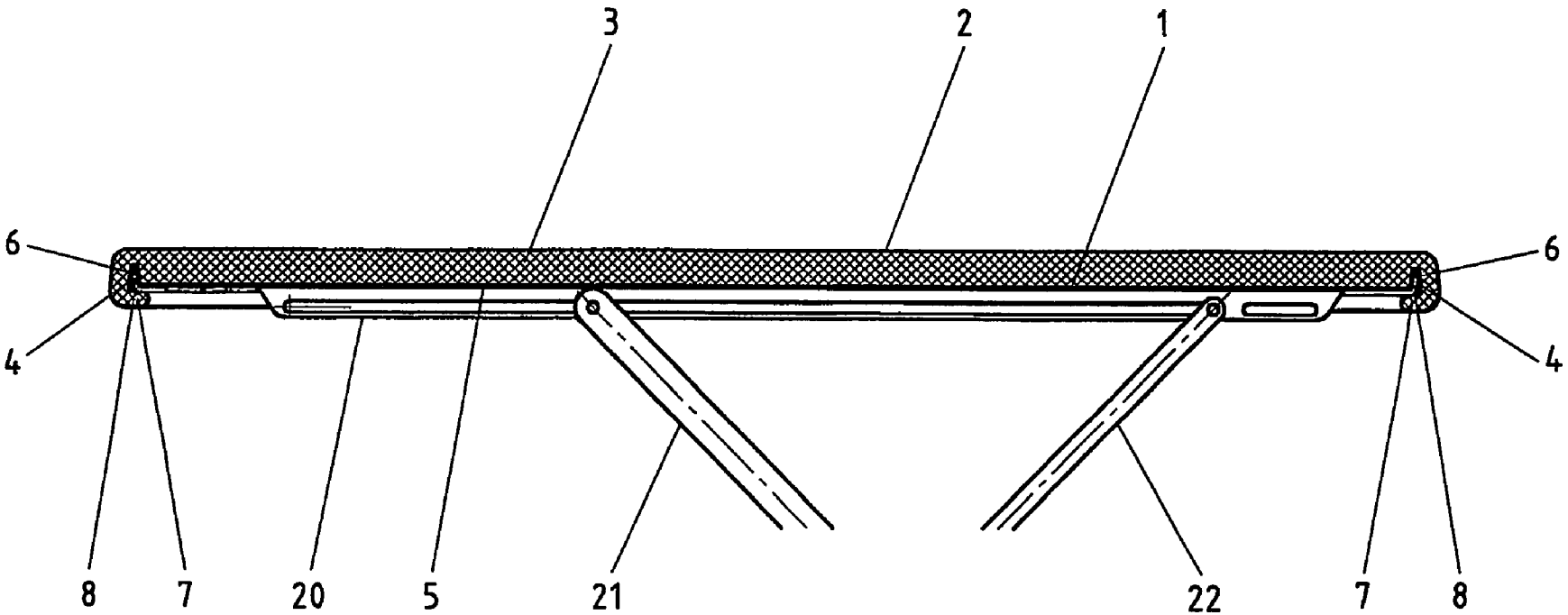
FIG. 1 shows a section of an ironing board having an ironing board cover, including an elastic padding, installed on it.

FIG. 1 shows a longitudinal section of an ironing board 1 having ironing board cover 2 and elastic padding 3. Longitudinal strips 20 and fold-out legs 21 and 22 are attached to ironing board 1. Ironing board 1 is made of expanded metal. The contour of the ironing board corresponds to the standards normally used today. Ironing board 1 is provided with peripheral edge 4, which holds padding 3. In the selected example, bottom 5 of padding 3 is provided with a peripheral groove 6, whose cross section corresponds to the outer contour of edge 4. Padding 3 is thus installed on edge 4 of ironing board 1 via its groove. Padding 3 is thus securely held in the horizontal plane of the board. To reinforce this attachment and also to prevent padding 3 from lifting from the ironing board, padding 3 has a peripheral bulge 7, via which it engages with edge 8 of ironing board 1 from behind.

Figure 2:
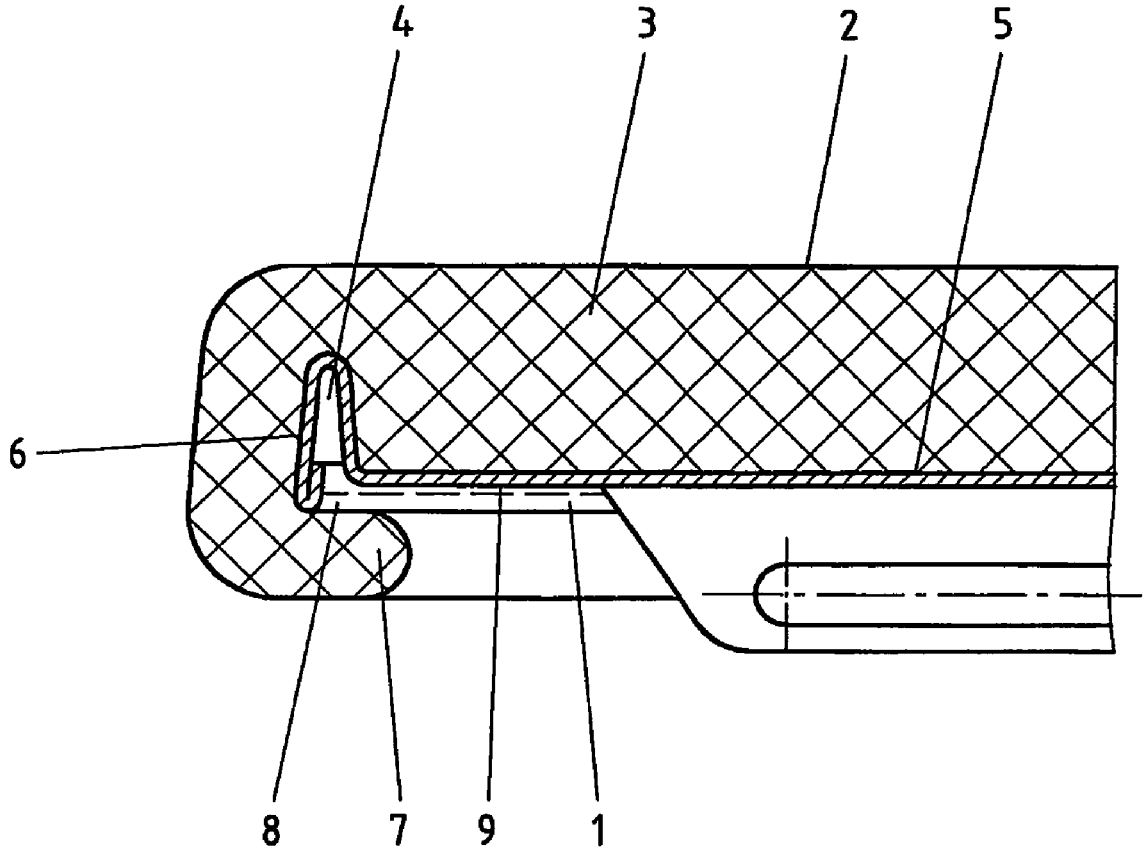
FIG. 2 shows an enlarged side section of FIG. 1.

FIG. 2 shows an enlarged view of the left side of ironing board 1 of FIG. 1. Edge 4 is directly attached to ironing board 1. It stands out over surface 9 of ironing board 1 and has a tapered design. The height of the edge protruding over surface 9 is approximately 2 cm. The base in this example is 0.8 mm. Padding 3 is made of an intrinsically rigid hard foam.

Figure 3:
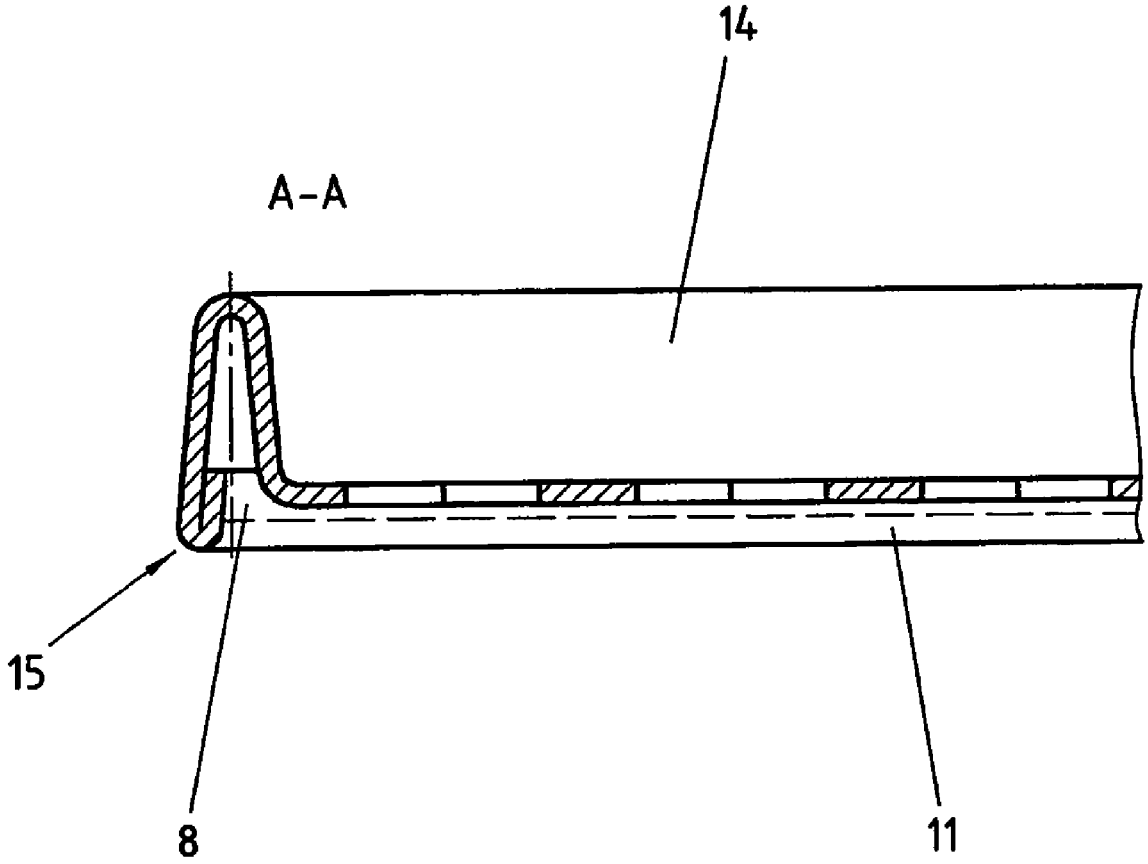
FIG. 3 shows a partial section of an edge, which may be installed separately on an ironing board.
Figure 4:
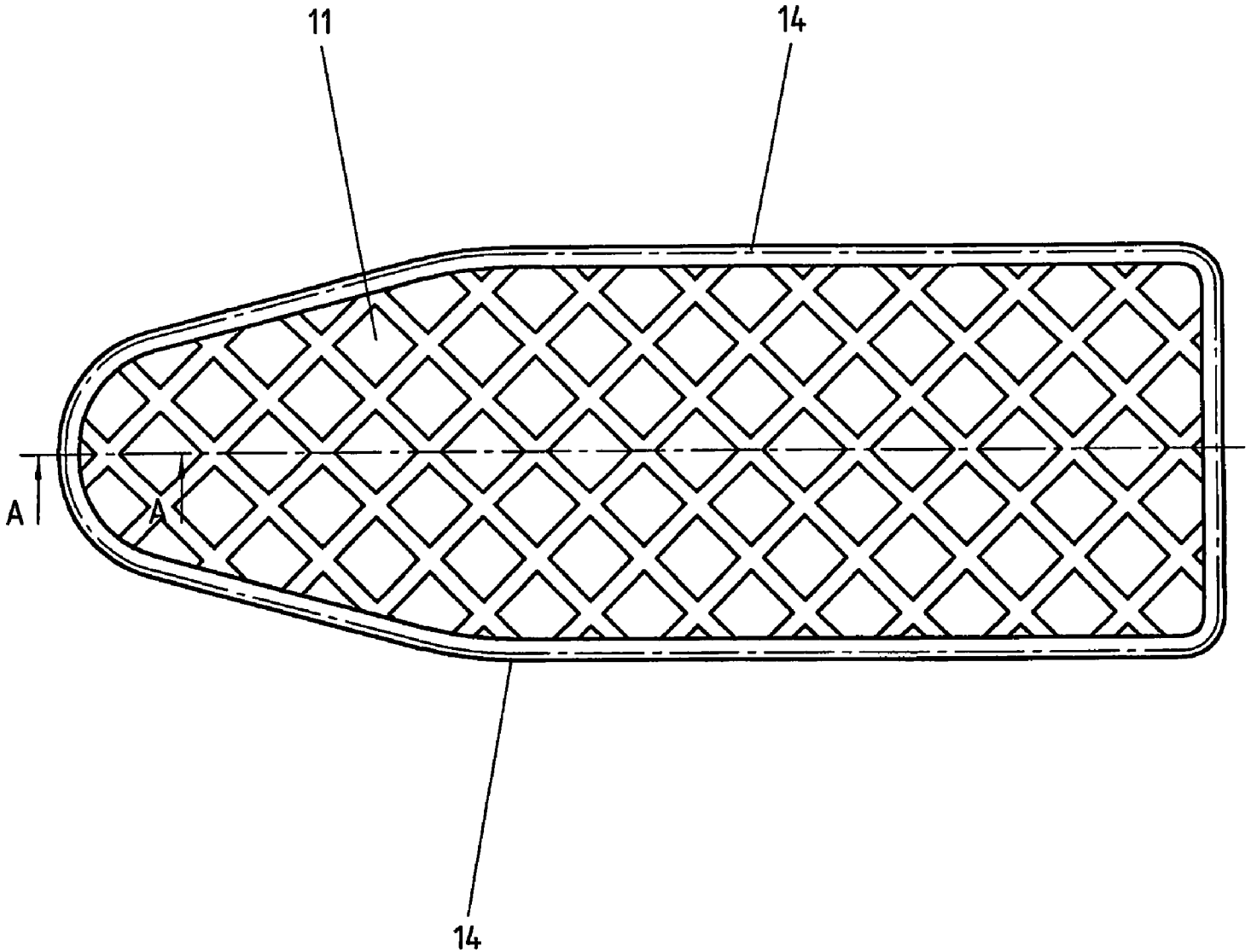
FIG. 4 shows a top view of an ironing board having an edge installed on it.

FIG. 3 shows the portion of an edge 14 partially sectioned; it is designed as a separate element and may be installed on an ironing board having a corresponding contour. It is advantageous if edge 14 is provided with a peripheral section 15 corresponding to the contour of ironing board 11 and enclosing edge 8 of ironing board 11. The design of edge 14 is otherwise comparable with edge 4 illustrated in FIGS. 1 and 2. Edge 14 and ironing board 11 are manufactured separately and edge 14 is form-fittingly pushed onto ironing board 11 as shown in FIG. 4. After attaching edge 14 to ironing board 11, a padding 3 having ironing board cover 2 as described for FIGS. 1 and 2 may be installed on ironing board 11.

What is claimed is:

1. An ironing board on which an ironing board cover having an elastic padding is installable, the ironing board comprising:

a board portion having a surface;

a peripheral edge standing out over the surface and configured to hold the elastic padding in an unshiftable manner; and wherein a bottom surface of the elastic padding includes a peripheral groove enclosing the peripheral edge of the ironing board.

2. The ironing board as recited in claim 1, wherein the padding is enclosed by the edge of the ironing board.

3. The ironing board as recited in claim 1, wherein the board portion includes an outer edge and the padding has a bulge engaging with the outer edge from behind.

4. The ironing board as recited in claim 3, wherein the peripheral edge is a separate element from the board portion and attachable to the board portion.

5. The ironing board as recited in claim 4, wherein the peripheral edge includes a peripheral section corresponding to a contour of the board portion and enclosing the outer edge.

6. The ironing board as recited in claim 1, wherein the peripheral edge stands out 0.2 to 5 cm over the surface.

7. The ironing board as recited in claim 1, wherein the peripheral edge stands out 0.5 to 2 cm, out over the surface.

8. The ironing board as recited in claim 1, wherein the peripheral edge has a tapered shape.

9. The ironing board as recited in claim 8, wherein a base of the tapered shape is 0.1 to 1.5 cm wide.

10. The ironing board as recited in claim 1, wherein the padding includes an intrinsically rigid hard foam.

* * * * *